US007353669B2

(12) United States Patent
Ternon et al.

(10) Patent No.: US 7,353,669 B2
(45) **Date of Patent: *Apr. 8, 2008**

(54) AIR BAG FABRIC AND INFLATABLE ELEMENTS FORMED THEREFROM

(75) Inventors: Gerard Ternon, Bolbec (FR); Ramesh Keshavaraj, Peachtree City, GA (US)

(73) Assignee: Milliken & Company, Spartanburg, SC (US)

( * ) Notice: Subject to any disclaimer, the term of this patent is extended or adjusted under 35 U.S.C. 154(b) by 118 days.

This patent is subject to a terminal disclaimer.

(21) Appl. No.: 10/993,987

(22) Filed: Nov. 19, 2004

(65) Prior Publication Data

US 2006/0110995 A1 May 25, 2006

(51) Int. Cl.
*D04B 23/12* (2006.01)

(52) U.S. Cl. ..... 66/192; 442/314; 280/728.1

(58) Field of Classification Search ..... 66/190–195; 442/305, 313, 314, 315; 280/728.1
See application file for complete search history.

(56) References Cited

U.S. PATENT DOCUMENTS 5,692,777 A 12/1997 Tochacek ..... 280/743.1
5,916,830 A 6/1999 Graham ..... 442/314
5,945,359 A 8/1999 Graham ..... 442/314
7,013,681 B1 * 3/2006 Ternon et al. ..... 66/192
2006/0107701 A1 * 5/2006 Ternon et al. ..... 66/195

FOREIGN PATENT DOCUMENTS

EP 0 965 670 12/1999

* cited by examiner

*Primary Examiner*—Arti Singh
(74) *Attorney, Agent, or Firm*—Terry T. Moyer; John E. Vick, Jr.

(57) ABSTRACT

An air bag substrate fabric utilizing a tying yarn knitting arrangement wherein a portion of the tying yarns are threaded to engage needles so as to form two stitches with one on either side of the inlay warp yarn at rows of stitch formation. The neighboring stitches resist yarn separation and resultant combing while also blocking the commencement and propagation of de-knitting when a tying yarn is broken.

9 Claims, 9 Drawing Sheets

AIR BAG FABRIC AND INFLATABLE ELEMENTS FORMED THEREFROM

TECHNICAL FIELD

This invention relates to a weft inserted warp knit fabric for use in a vehicle air bag and in particular to a weft inserted warp knit fabric for air bags providing a stable construction having strength and stability characteristics comparable to traditional woven air bag fabrics while greatly reducing the quantity of yarn used in producing the fabric.

BACKGROUND OF THE INVENTION

A safety restraint in the form of an inflatable cushion disposed within a supporting structure such as a dash panel, side door or other fixed portion of a car body in opposing relation to a seat in the vehicle plays an important role in protecting the occupants in a vehicle from injury due to collision against the car body. Typically, the inflatable cushion is inflated rapidly by the pressure of a reaction gas released from an inflator during a collision event. This gas generation typically takes place when a gas generating agent in the inflator induces a chemical reaction activated by a collision signal from a collision detecting sensor when the deceleration of the vehicle exceeds a certain level. The gas which is generated by the generator is then conveyed to the inflatable cushion which expands outwardly as it fills with gas to create a protective barrier between the vehicle occupant and the portion of the vehicle body against which the occupant might other wide be thrown.

Inflatable air bag systems have been used in the past to protect both the operator of the vehicle and passengers. Inflatable cushions for the protection of the vehicle operator have been mounted in the steering column of the vehicle and have utilized cushion constructions directly deployable towards the driver. These driver-side cushions are generally of a relatively simple configuration in that they function over a fairly small, well-defined area between the driver and the steering column. Inflatable cushions for use in the protection of passengers against frontal or side impacts must generally have a more complex configuration since the position of a vehicle passenger may not be well defined and greater distance may exists between the passenger and the surface of the vehicle against which that passenger might be thrown in the event of a collision. Curtain-type air bags that remain inflated for extended periods of time at positions between a vehicle occupant and windows or other points of possible ejection are also known for use in protecting occupants during an extended roll-over event.

Air bags of all constructions normally include one or more seams connecting panels of fabric together. In addition, curtain-type air bags often include an arrangement of welded or sewn seams inboard of the perimeter. These inboard seams form so called zero length tethers between opposing panels so as to define a desired arrangement of inflation zones while maintaining a substantially flat inflation profile.

Past air bag constructions have relied upon woven fabrics to provide multi-directional strength. While such woven constructions perform extremely well, such constructions also utilize substantial quantities of yarn and may be somewhat thick and bulky due to the fact that the yarns run over and under one another. It has also been proposed to use laminated weft inserted warp knit constructions in place of traditional woven constructions. By way of example only, prior air bag fabrics incorporating weft inserted warp knit constructions are disclosed in U.S. Pat. Nos. 5,916,830 and 5,945,359 to George M. Graham, the contents of all of which are hereby incorporated by reference as if fully set forth herein.

Regardless of the fabric construction utilized, the zones adjacent the seams may experience relatively high stress levels during inflation and impact as the panels held by the seams attempt to separate from one another. Due to these stress levels the zones immediately adjacent the seams may be subject to so called "combing" wherein the yarns adjacent the seam spread apart form one another under pressure and thereby cause increased gas leakage. In undesirable situations such combing may also be accompanied by localized yarn breakage due to stress and/or damage from sewing needles. In order to reduce adverse consequences of seam combing and yarn breakage it has been common practice to utilize tightly woven constructions wherein the yarns forming the fabric are packed together in interwoven relation at a relatively high density. Such constructions reduce combing and also tend to arrest any propagation of a tear if one develops in the fabric.

In the past, knit structures have generally been considered to have limited utility in an air bag environment due to the fact that such constructions may be more prone to combing due to reduced structural stability. Moreover, localized yarn breakage may lead to an unraveling of the fabric thereby leading to extended tears. In traditional weft inserted warp knit fabrics such as those described in U.S. Pat. Nos. 5,916,830 and 5,945,359 to George M. Graham, a layer of in-lay warp yarns is disposed across a layer of inserted weft yarns such that the warp yarns are disposed in a first plane and the weft yarns are in a second different plane. The warp yarns and the weft yarns are bound together by a smaller tying yarn or stitching yarn that is knit so as to form an arrangement of stitches with one stitch at each row. In these prior constructions if the tying yarn is broken such as when the fabric is cut or sewn, the tying yarn can begin to de-knit and the inlay warp yarns can pull away from the weft yarns. While the effect of such de-knitting may be at least partially addressed by using two or more layers of fabric laminated together, such lamination may give rise to an undue level of complexity. Moreover, the total thickness and fiber requirements for a multi-layer construction with two adjoined layers of weft inserted warp kit fabric may offer little improvement over traditional single layer woven constructions.

SUMMARY OF THE INVENTION

The present invention provides advantages and alternatives over the prior art by providing an air bag substrate fabric of weft inserted warp knit construction that will perform in an inflatable air bag to protect the occupant of a transportation vehicle upon occurrence of an accident without the propensity for increased combing and de-knitting associated with prior weft inserted warp knit constructions. These benefits are achieved even when only a single layer of the weft inserted warp knit fabric is utilized in combination with an appropriate permeability blocking covering.

According to one aspect of the invention, an air bag substrate fabric of weft inserted warp knit construction is provided utilizing a tying yarn knitting arrangement wherein each tying yarn is threaded so as to form two stitches (one on either side of the inlay warp yarn) at each row of stitch formation. The neighboring stitches resist yarn separation and resultant combing while also blocking the commencement and propagation of de-knitting when a tying yarn is broken such as by sewing, cutting or the like.

According to another aspect of the invention, an air bag substrate fabric of weft inserted warp knit construction is provided utilizing a tying yarn knitting arrangement wherein two or more tying yarns are threaded such that each tying yarn forms two stitches (one on either side of the inlay warp yarn) at each row of stitch formation. The neighboring stitches resist yarn separation and resultant combing while also blocking the commencement of de-knitting when a tying yarn is broken. Moreover, even if one tying yarn undergoes breakage and de-knitting, an independent yarn with stitches on either side of the inlay warp yarn remains in place.

According to another aspect of the invention an air bag substrate fabric of weft inserted warp knit construction is provided incorporating a layer of fibrous material or film through which tying yarns extend in a stitch forming pattern.

According to yet another aspect of the invention an air bag substrate fabric of weft inserted warp knit construction is provided that is suitable for lamination to additional layers.

According to yet another aspect of the invention an air bag substrate fabric of weft inserted warp knit construction is provided that is suitable for acceptance of a topical transfer coating across one or both sides.

According to still another aspect of the invention an air bag substrate fabric of weft inserted warp knit construction is provided that is suitable for acceptance of an extrusion coating across one or both sides.

According to other aspects of the invention methods of making an air bag substrate fabric of weft inserted warp knit construction and inflatable air bags incorporating an air bag substrate fabric of weft inserted warp knit construction are also provided.

BRIEF DESCRIPTION OF THE DRAWINGS

The accompanying drawings which are incorporated in and which constitute a part of this specification illustrate an exemplary embodiment of the present invention and together with the detailed description set forth below serve to explain the principles of the invention wherein.

DESCRIPTION OF PREFERRED EMBODIMENTS

Figure 1:
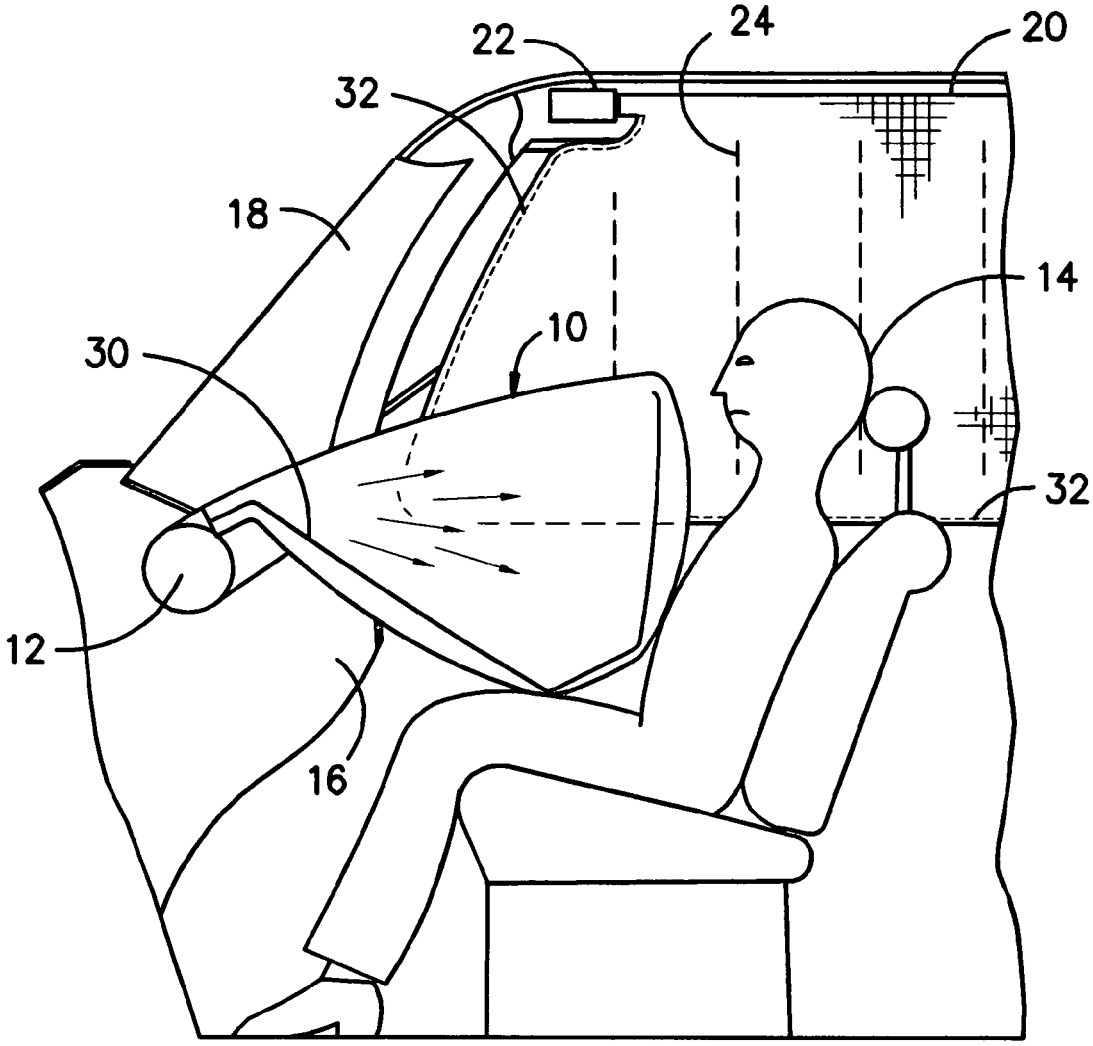
FIG. 1 shows a cut-away view of a transportation vehicle illustrating an inflatable air bag cushion in deployment between a vehicle occupant and a dash panel and an inflatable air bag curtain in deployment to the side of the occupant.

Turning now to the drawings, wherein like elements are denoted by like reference numerals in the various views, in FIG. 1 there is shown an air bag in the form of an inflatable cushion 10 for use with an inflator 12 to protect a vehicle occupant 14 from impacting against a dash panel 16, windshield 18 or other interior surface in the event of a collision. The vehicle also includes an air bag in the form of an inflatable curtain 20 for use with an inflator 22 to protect the occupant 14 during a prolonged roll-over event. As shown, the inflatable curtain 20 may include an arrangement of so called zero length tethers 24 operatively connecting front and rear panels of the cushion 20 together to control the gas flow path and the inflated thickness of the cushion 20. As will be understood by those of skill in the art, both the inflatable cushion 10 and the inflatable curtain 20 include joining seams 30, 32 so as to connect panels of material together in a desired three dimensional shape. Such seams may be of any suitable type as will be known to those of skill in the art including sewn seams, adhesive seams, welded seams or the like.

Figure 2:
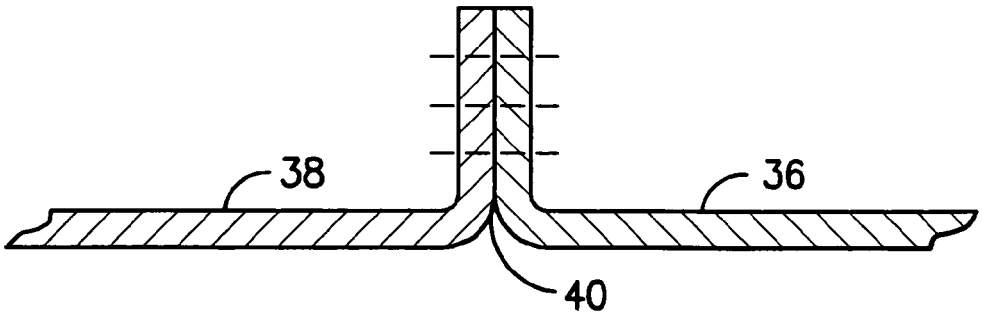
FIG. 2 illustrates a generic simple seam construction.

By way of example only, and not limitation, an illustrative simple seam construction is illustrated in FIG. 2. As shown, in a seamed construction a first panel 36 formed from a blank of suitable construction material such as a fabric or the like is joined to a second panel 38 formed from a blank of suitable construction material such as a fabric or the like along a seam line 40 by suitable stitching threads. In construction of an air bag, after the seam line 40 is formed, the joined segments shown as projecting upwardly in FIG. 2 may thereafter be folded over and attached to the surface of one of the panels 38, 40 by stitching so as to develop a so called "foldover" or "top stitch" seam. As will be appreciated, regardless of the seam structure when a force is applied pulling the panels away from one another, the panels are placed into tension with high levels of stress immediately adjacent the seam line 40.

In air bag construction it is contemplated that adhesives may be used between the panels along the seam line 40 with stitching threads extending across the adhesive. The combination of adhesive with sewn seams may reduce the potential for gas leakage around the perforating sewing threads. By way of example only, and not limitation, various contemplated adhesives include an adhesive marketed by Toray and Dow Chemical Company under the trade designation SE6714; an adhesive marketed by Shinetsu under the trade designation X-323-83; an adhesive marketed by Dow Chemical Company under the trade designation DOW-832; an adhesive marketed by Rhodia under the trade designation SILBIONE; an adhesive marketed by Wacker under the trade designation ELASTOSIL; and an adhesive marketed by General Electric under the trade designation WMO-0106-570.

Even when seams are formed incorporating appropriate adhesives, in the event that the panels 36, 38 are textile fabrics formed from an arrangement of crossing yarns, the yarns of the fabrics tend to spread apart under tension thereby causing spaces between the yarns to open up and creating the phenomenon known as combing in which pin holes open up. In extreme cases one or more yarns may break. As will be appreciated, combing and yarn breakage are generally undesirable in an air bag due to the accompanying uncontrolled gas discharge.

The present invention utilizes blanks of a weft inserted warp knit fabric as a substrate to form one or more panels of a vehicle air bag such as an inflatable cushion 10 and/or inflatable curtain 20. Of course, in this regard it is to be understood that the illustrated constructions of such inflatable elements are provided merely for exemplary and explanatory purposes and that the present invention is in no way limited to a particular cushion or curtain configuration.

Figure 3:
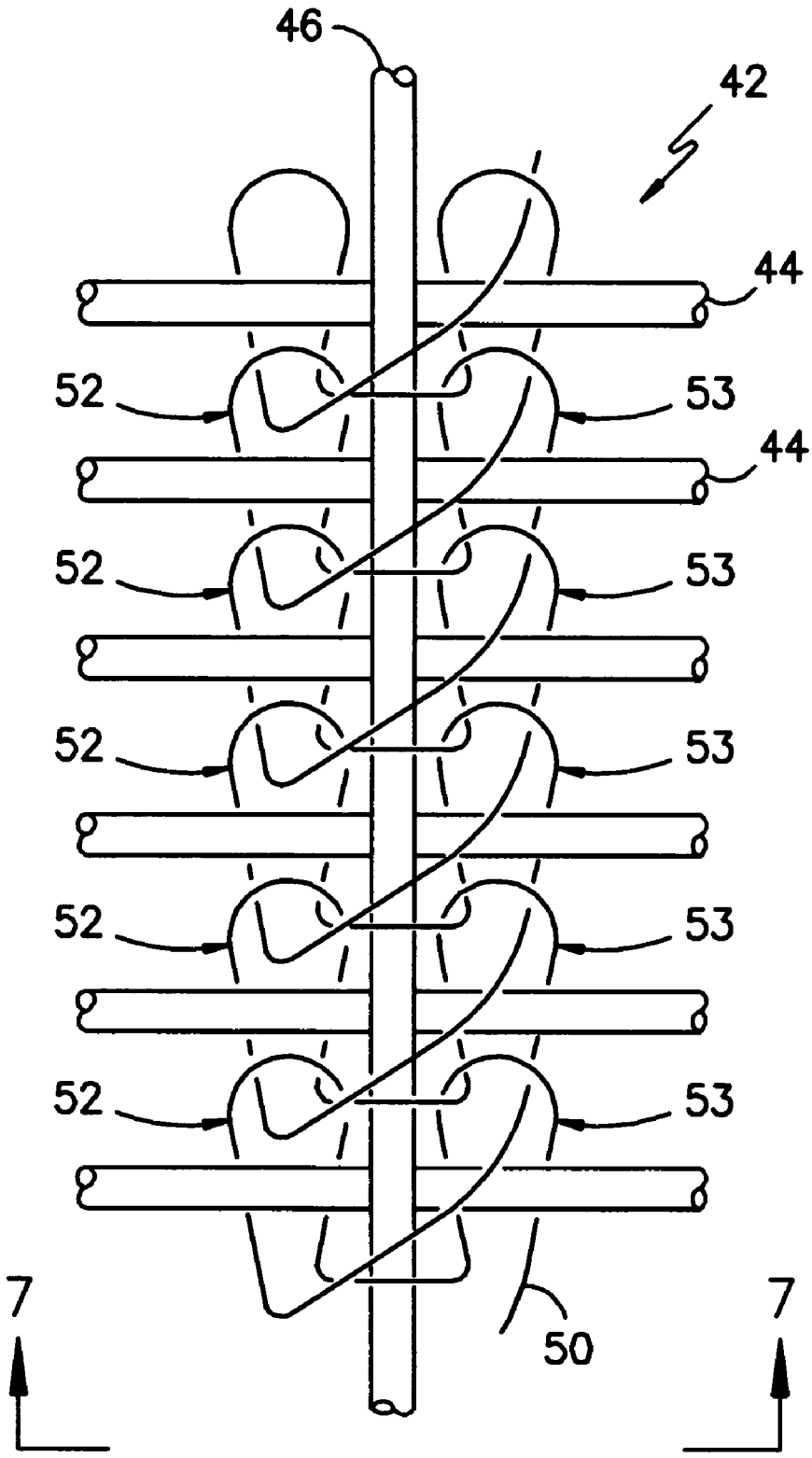
FIG. 3 is a view illustrating a two bar weft inserted warp knit construction for an air bag fabric with a tying yarn forming pairs of stitches on either side of an inlay warp yarn at every row of stitch formation.
Figure 4:
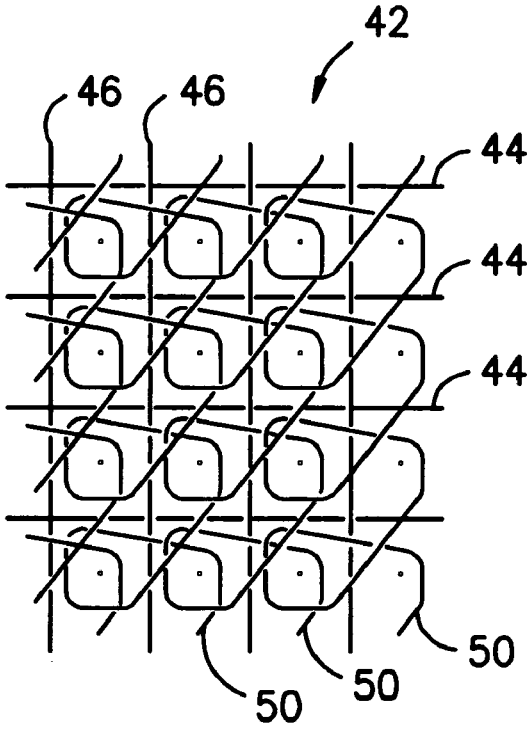
FIG. 4 is a needle point diagram showing the yarn stitch arrangement for the fabric construction illustrated in FIG. 3 wherein each tying yarn engages a pair of needles on either side of inlay warp yarns to form stitches on either side of the inlay warp yarns.

A first exemplary construction of a weft inserted warp knit substrate fabric 42 for use in a vehicle air bag is shown in FIGS. 3 and 4. As shown, in this construction the fabric 42 includes an arrangement of substantially parallel weft yarns 44 in a first plane with a plurality of in-lay warp yarns 46 disposed in a second different plane. A tying yarn 50 (also referred to as a stitching yarn) is knitted with a stitch pattern extending in the machine direction such that each tying yarn forms a double column of stitches with two stitches 52, 53 made at each row of the stitch formation. The stitches 52 in the first column are on one side of a warp yarn 46 and the stitches 53 in the second column are on the opposite side. Such a weft inserted warp knit fabric construction may be formed using commercially available equipment as will be well known to those of skill in the art. By way of example only, and not limitation, one manufacturer of such equipment is Karl Mayer—Malimo Gmbh, located in Chemnitz Germany. Another manufacturer is Liba Gmbh located in Naila Germany.

As will be understood, a stitch is formed when a yarn loop is pulled through a preceding yarn loop. In the present construction where the tying yarn forms two stitches at each row of stitch formation, the yarn is less prone to de-knitting than a construction wherein each tying yarn forms only a single stitch. As illustrated, the two stitches 52, 53 formed by each yarn at each row of stitch formation are preferably disposed on opposite sides of a warp yarn 46 with one weft yarn inserted at every row of stitch formation. However, it is also contemplated that the weft yarns 44 may be inserted more sparingly such that there are multiple rows of stitches for each weft yarn 44. Likewise, it is also contemplated that there may be multiple wefts for each row of stitches.

In practice it is contemplated that the actual yarn selection may be subject to a wide range of alternatives. By way of example only, it is contemplated that the weft yarns 44 and in-lay warp yarns 46 may be characterized by a linear density in the range of about 1.9 denier (2 dtex) to about 1500 denier (1670 dtex). Such yarns may be monofilament or multifilament with flat, textured or spun construction. The tying yarn 50 is preferably characterized by a linear density in the range of about 5.5 denier (6 dtex) to about 250 denier (280 dtex). Each of the yarns may be formed of suitable fiber materials such as polyester, nylon, polyurethane, aramid, polyethylene, NOMEX® or the like depending upon the final desired construction characteristics. It is also contemplated that combinations of any such yarns or materials may be utilized if desired.

Referring to FIGS. 3 and 4, in the illustrated pattern the tying yarn 50 is arranged to engage two needles at each row with a closed stitch notation of (0.2/0.2). In the illustrated construction the in-lay warp yarn 46 is disposed between the same two needles thereby assuming a stitch notation of (0.0/0.0). Thus, the fabric is a two bar fabric in which one bar carries the in-lay warp yarn 46 and the other bar carries the tying yarn 50.

Figure 5:
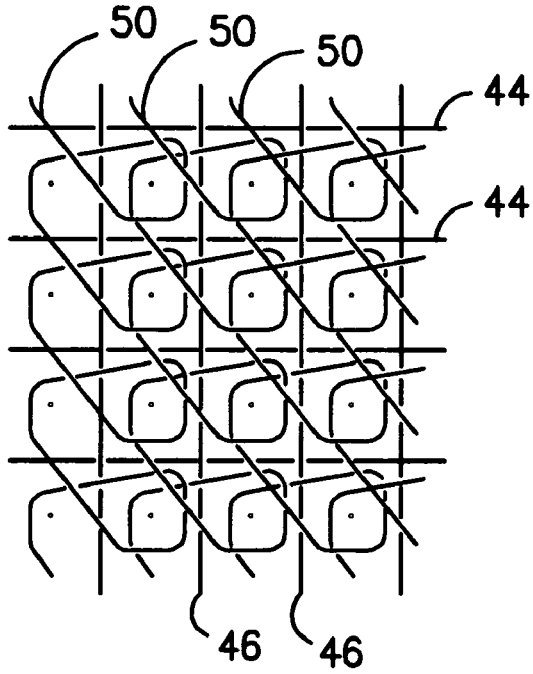
FIG. 5 is a needle point diagram showing another yarn stitch arrangement wherein each tying yarn engages a pair of needles on either side of inlay warp yarns to form stitches on either side of the inlay warp yarns.

Of course, it is contemplated that the actual stitching arrangement is adaptable to numerous variations that nonetheless cause the tying yarn 50 to form two stitches at each stitch formation row. By way of example only, it is contemplated that the tying yarns 50 may be threaded to move in the opposite direction around the needles so as to utilize a closed stitch notation of (2.0/2.0) as shown in FIG. 5. Still other contemplated closed stitch notations for the tying yarns 50 are (2.0/1.3) or (2.0/2.4). The tying yarn 50 may also be knitted in an open stitch arrangement if desired. Exemplary stitch notations for such open stitch arrangements include (0.2/2.0), (2.0/0.2), (0.2/3.1) and (0.2/4.2). It is also contemplated that the inlay warp yarns 46 may be moved in a pattern between adjacent needles in a zigzag orientation such as by using a stitch notation of (0.0/1.1) or (1.1/0.0).

In the arrangements illustrated in FIGS. 3-5, the guide bars are fully threaded. However, it is also contemplated that one or both bars can be only partially threaded such that yarns are taken out of the construction and a more open fabric is produced. Such partially threaded constructions may offer the benefit of further reducing yarn requirements. It is also contemplated that all or a portion of the warp yarns 46 and/or all or a portion of the weft yarns 44 may be eliminated if desired such that the tying yarn 50 is in the form of a more open knit structure.

Figure 6:
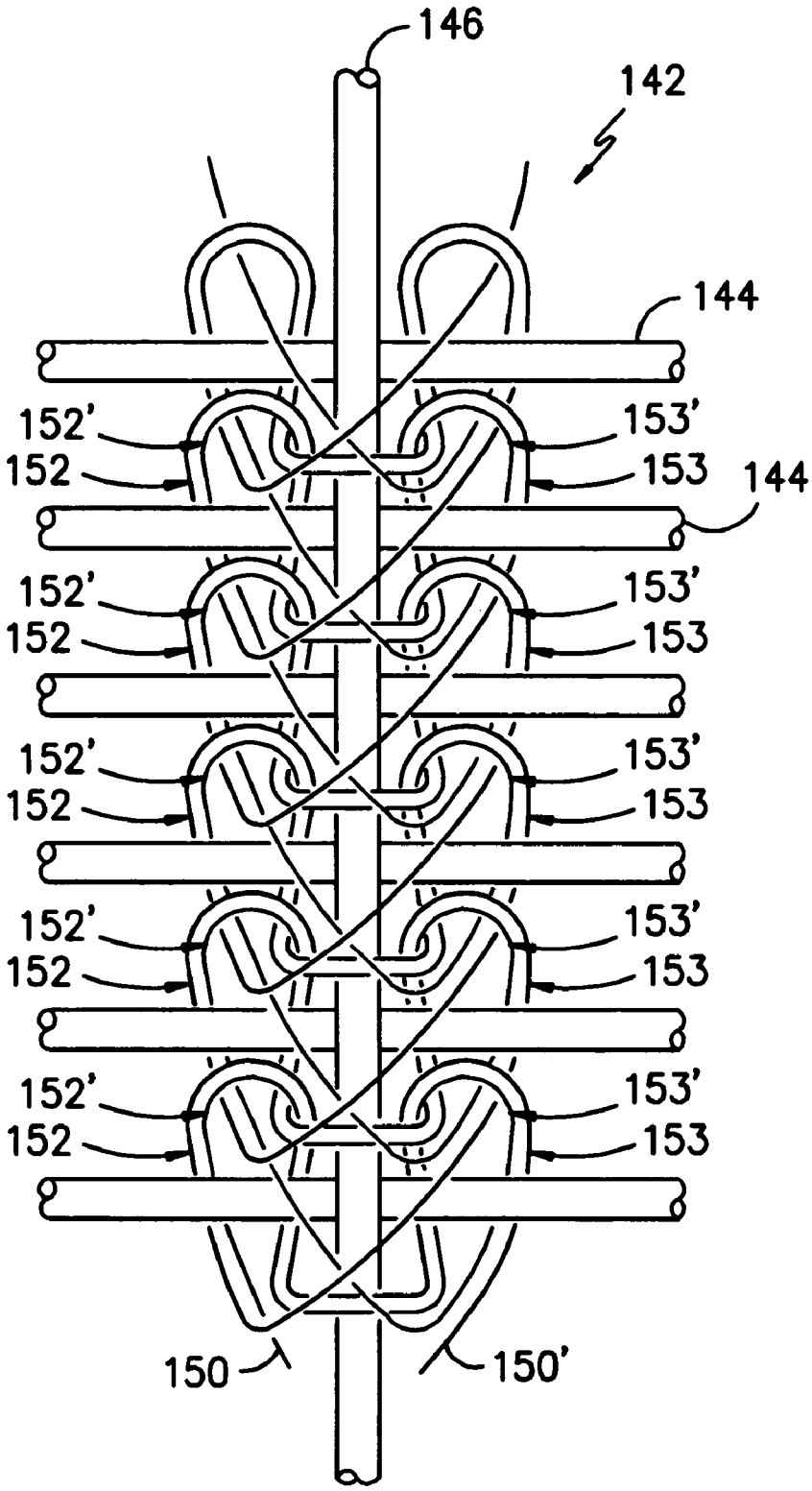
FIG. 6 is a view illustrating a three bar weft inserted warp knit construction for an air bag fabric with two tying yarns each forming pairs of stitches on either side of an inlay warp yarn at every row of stitch formation.
Figure 6A:
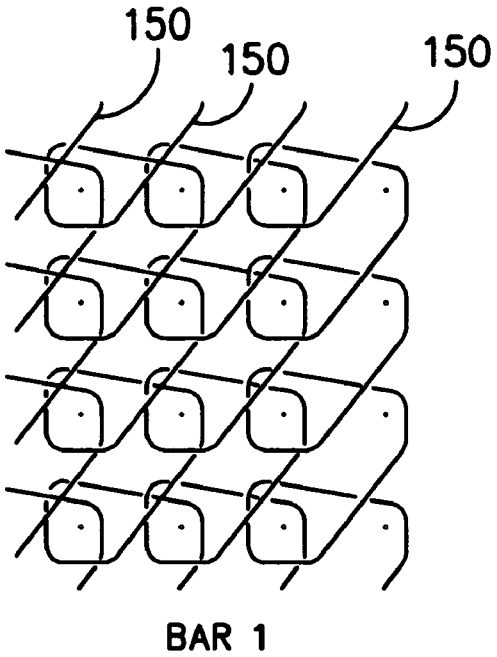
FIG. 6A is a needle point diagram illustrating the yarn movement of the bar 1 tying yarn in formation of the fabric illustrated in FIG. 6.
Figure 6B:
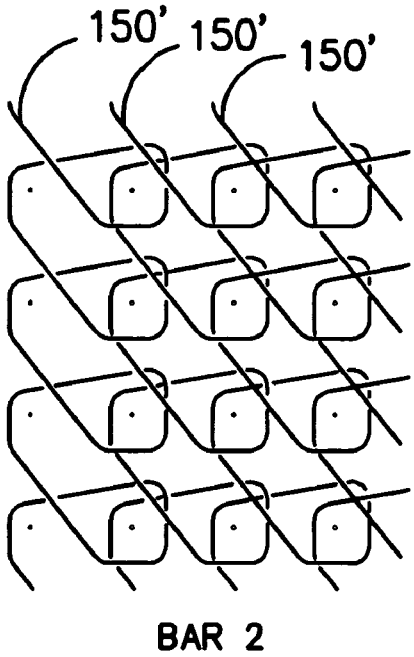
FIG. 6B is a needle point diagram illustrating the yarn movement of the bar 2 tying yarn in formation of the fabric illustrated in FIG. 6.
Figure 6C:
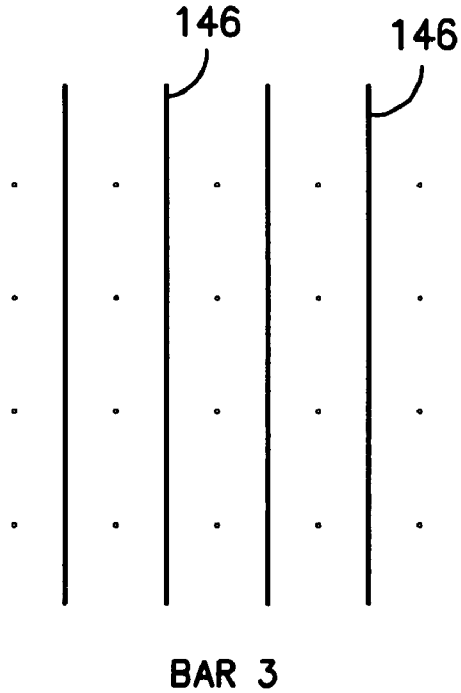
FIG. 6C is a needle point diagram illustrating the bar 3 warp yarn in the fabric illustrated in FIG. 6.

In FIG. 6 there is illustrated another embodiment of a weft inserted warp knit air bag substrate fabric 142 wherein elements corresponding to those previously described are designated by like reference numerals increased by 100. As will be appreciated, the construction illustrated in FIG. 6 is a three bar construction in which bar 1 carries tying yarn 150 with a movement around two needles at each row with a closed stitch notation of (0.2/0.2) thereby yielding a pair of stitches 152,153 on either side of the in-lay warp yarn 146. The bar 1 movement is illustrated in FIG. 6A. In the construction illustrated in FIG. 6, a second tying yarn 150' is carried by bar 2 with a movement around two needles at each row in a pattern opposite to the bar 1 tying yarn so as to form a closed stitch notation of (2.0/2.0) thereby yielding a pair of stitches 152', 153' on either side of the in-lay warp yarn 146. The bar 2 movement is illustrated in FIG. 6B. Bar 3 carries the in-lay warp yarn 146. The bar 3 yarn is illustrated in FIG. 6C. At each row of stitch formation two stitches are formed on each side of in-lay warp yarn 146. Since the tying yarns 150, 150' are independent from one another; if one tying yarn is broken the remaining tying yarn continues to prevent undue levels of yarn separation.

As with the previously described two bar construction, it is contemplated that the actual yarn selection in the three bar construction may also be subject to a wide range of alternatives. By way of example only, it is contemplated that the weft yarns 144 and in-lay warp yarns 146 may be characterized by a linear density in the range of about 1.9 denier (2 dtex) to about 1500 denier (1670 dtex). Such yarns may be monofilament or multifilament with flat, textured or spun construction. The tying yarns 150, 150' are preferably characterized by a linear density in the range of about 5.5 denier (6 dtex) to about 250 denier (280 dtex). Each of the yarns may be formed of suitable fiber materials such as polyester, nylon, polyurethane, aramid, polyethylene, NOMEX® or the like depending upon the final desired construction characteristics. It is also contemplated that combinations of any such yarns and materials may be utilized if desired.

Of course, it is contemplated that the actual stitching arrangement is adaptable to numerous variations that nonetheless cause the tying yarns 150, 150' to each form two stitches at each stitch formation row. The tying yarns 150, 150' may also be knitted in an open stitch arrangement if desired. It is also contemplated that the in-lay warp yarns 146 may be moved in a pattern between adjacent needles in a zigzag orientation such as by using a stitch notation of (0.0/1.1) or (1.1/0.0). It is also contemplated that one, two or three bars can be only partially threaded if desired such that yarns are taken out of the construction and a more open fabric is produced. In this regard it is contemplated that all or a portion of the warp yarns 46 and/or all or a portion of the weft yarns 44 may be eliminated if desired such that a more open knit structure is realized.

As will be understood, even the fully threaded weft inserted warp knit air bag substrate fabrics described herein are of a relatively loose construction compared to traditional woven air bag fabrics. By way of example, a weft inserted warp knit as illustrated and described in relation to FIG. 6 and including a suitable permeability blocking covering has a mass per unit area that is about 35% less than a woven fabric formed from yarns with comparable linear densities. This reduction in weight corresponds to a substantially reduced requirement for fibrous yarns.

In order to control permeability in the relatively open constructions of the disclosed substrate fabrics a permeability blocking coating is preferably applied across at least one side of the weft inserted warp knit fabric. By the term "coating" is meant one or more layers of any applied covering material. By way of example only, and not limitation, such coatings may include laminated films, transfer coatings, extrusion coatings and the like. High strength polymeric films may be particularly preferred. By way of example only, and not limitation, vanous contemplated film materials may include acrylates, polyolefins, polyethers, polyesters, polycarbonates and polyurethanes. By way of example only, such films may be applied to a side of the well inserted warn knit fabric by techniques such as hot film lamination using an intermediate adhesive precoat, as well as by transfer coating or extrusion coating.

Figure 7:
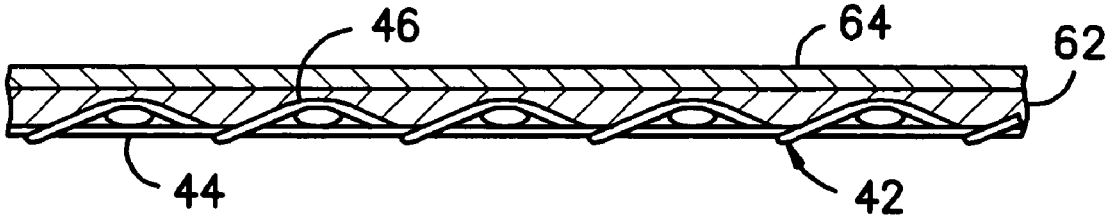
FIG. 7 is a view of a first embodiment of a weft inserted warp knit substrate with an applied permeability blocking covering looking in the warp direction along line 7-7 in FIG. 3.

One embodiment of the resultant air bag panel material following film lamination is illustrated in FIG. 7 wherein a weft inserted warp knit substrate 42 as previously described in relation to FIG. 3 is coated across one side with an adhesive precoat 62 and a film covering 64. Of course, the covering layers may also be applied across the other side of the substrate 42 or on both sides if desired. Likewise, suitable coatings may also be applied across one or both sides of a substrate 142 having multiple cooperative tying yarns as described in relation to FIG. 6.

Figure 8:
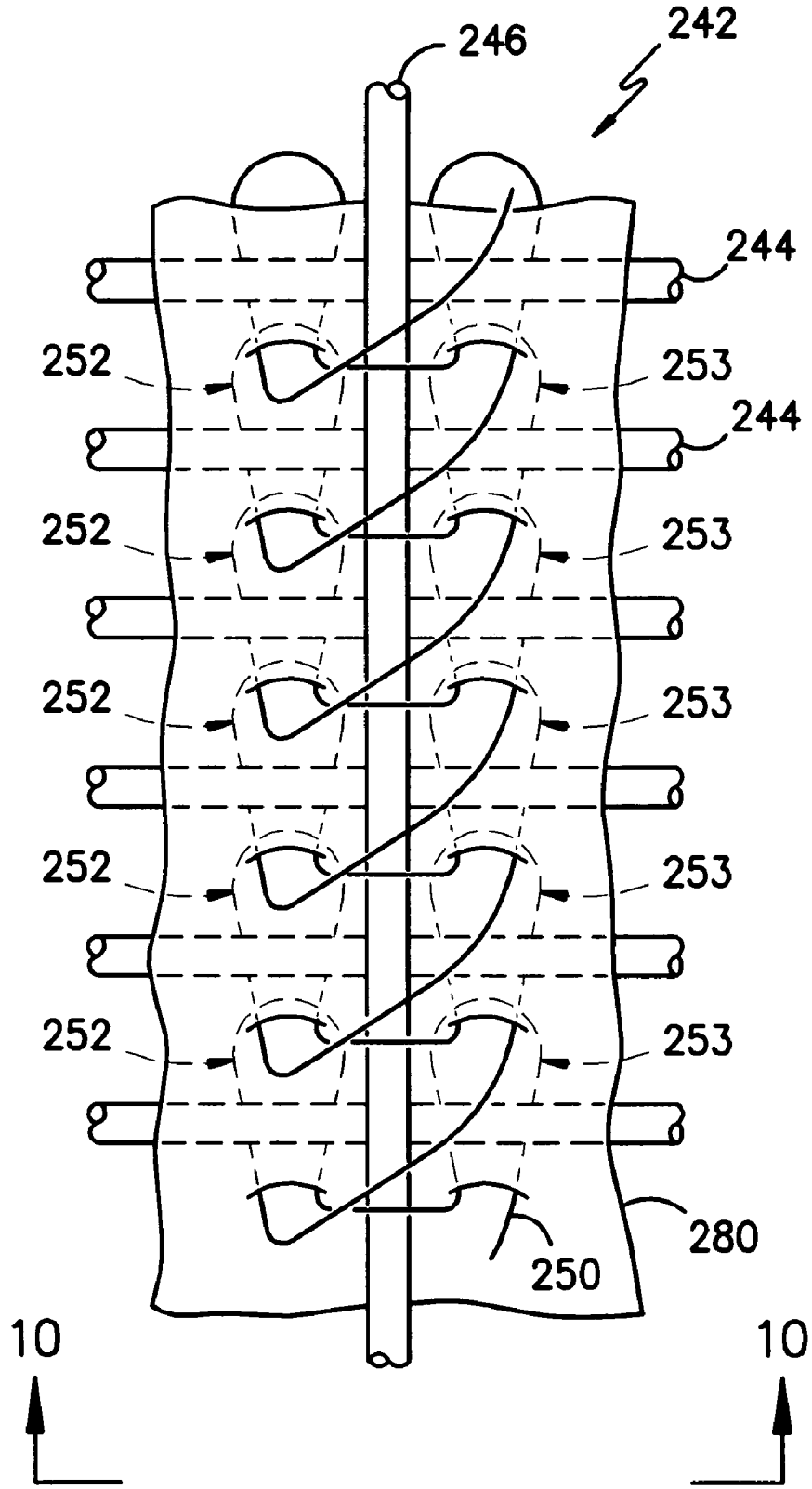
FIG. 8 is a view similar to FIG. 3, illustrating a two bar weft inserted warp knit construction for an air bag fabric with a tying yarn forming pairs of stitches on either side of an inlay warp yarn at every row of stitch formation and with stitches formed through a ground layer of fiber or film material disposed between the warp yarns and the weft yarns.

It is also contemplated that any of the weft inserted warp knit substrate constructions as previously described may further incorporate a fibrous or film ground layer through which the tying yarn is stitched. By way of example only, and not limitation, FIG. 8 illustrates a construction similar to FIG. 3 incorporating such a ground layer 280 disposed between the warp yarns 246 and the weft yarns 244 and wherein elements corresponding to those previously described are designated by corresponding reference numerals within a 200 series. The ground layer 280 may be any suitable material including a polymeric film, fibrous textile or the like. A nonwoven batting material of polyester or the like may be particularly desirable. As will be appreciated, the ground layer 280 may provide a degree of anchoring support and stability for the tying yarn 250. The ground layer may also aid in establishing a base for an effective permeability blocking coating. Of course, it is also contemplated that the ground layer 280 may be positioned on one side or the other of the construction formed by the warp yarns and the weft yarns rather than being located between the yarns.

Figure 9:
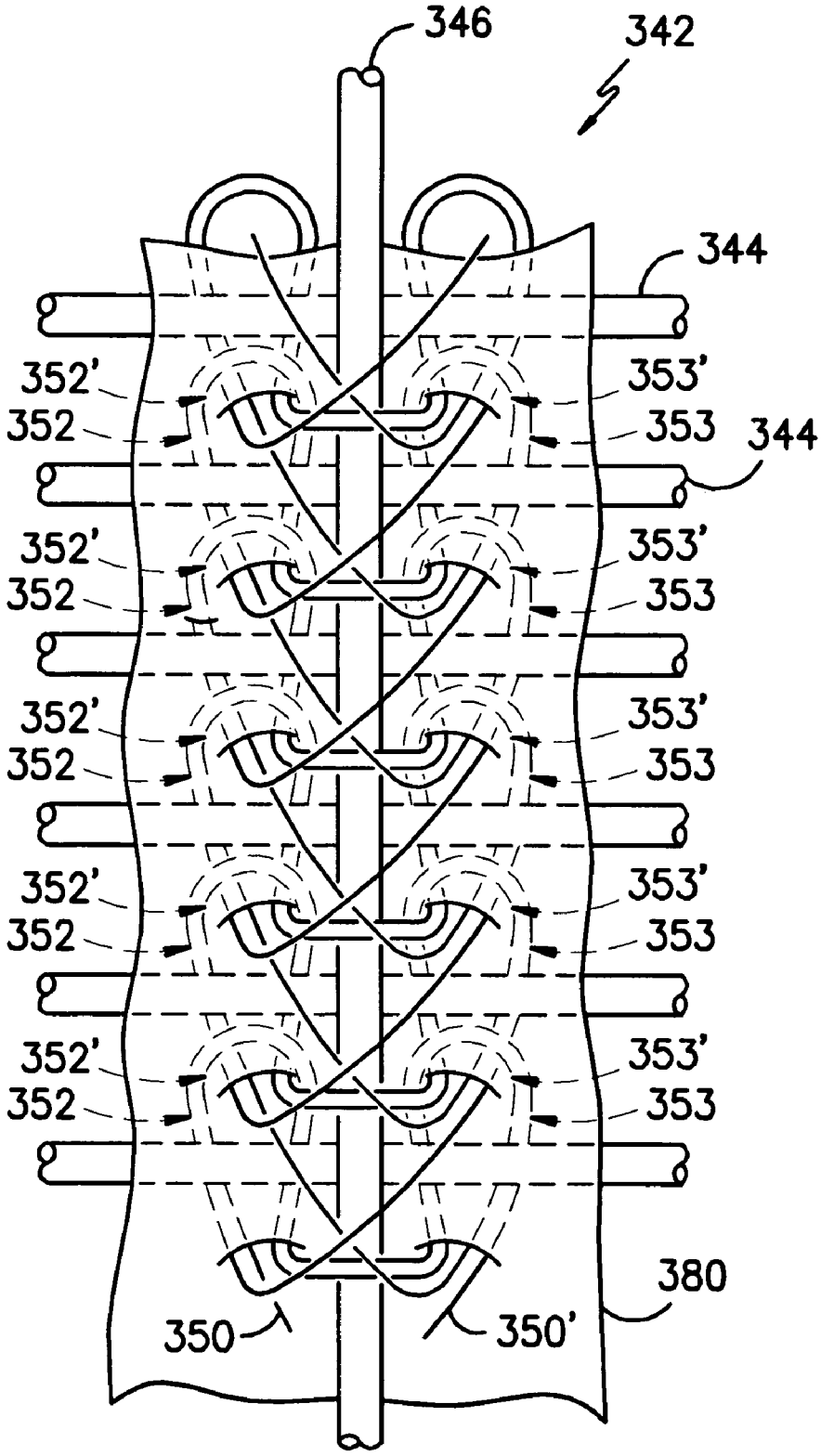
FIG. 9 is a view similar to FIG. 6, illustrating a three bar weft inserted warp knit construction for an air bag fabric with two tying yarns each forming pairs of stitches on either side of an inlay warp yarn at every row of stitch formation and with stitches formed through a ground layer of fiber or film material disposed between the warp yarns and the weft yarns.
Figure 11:
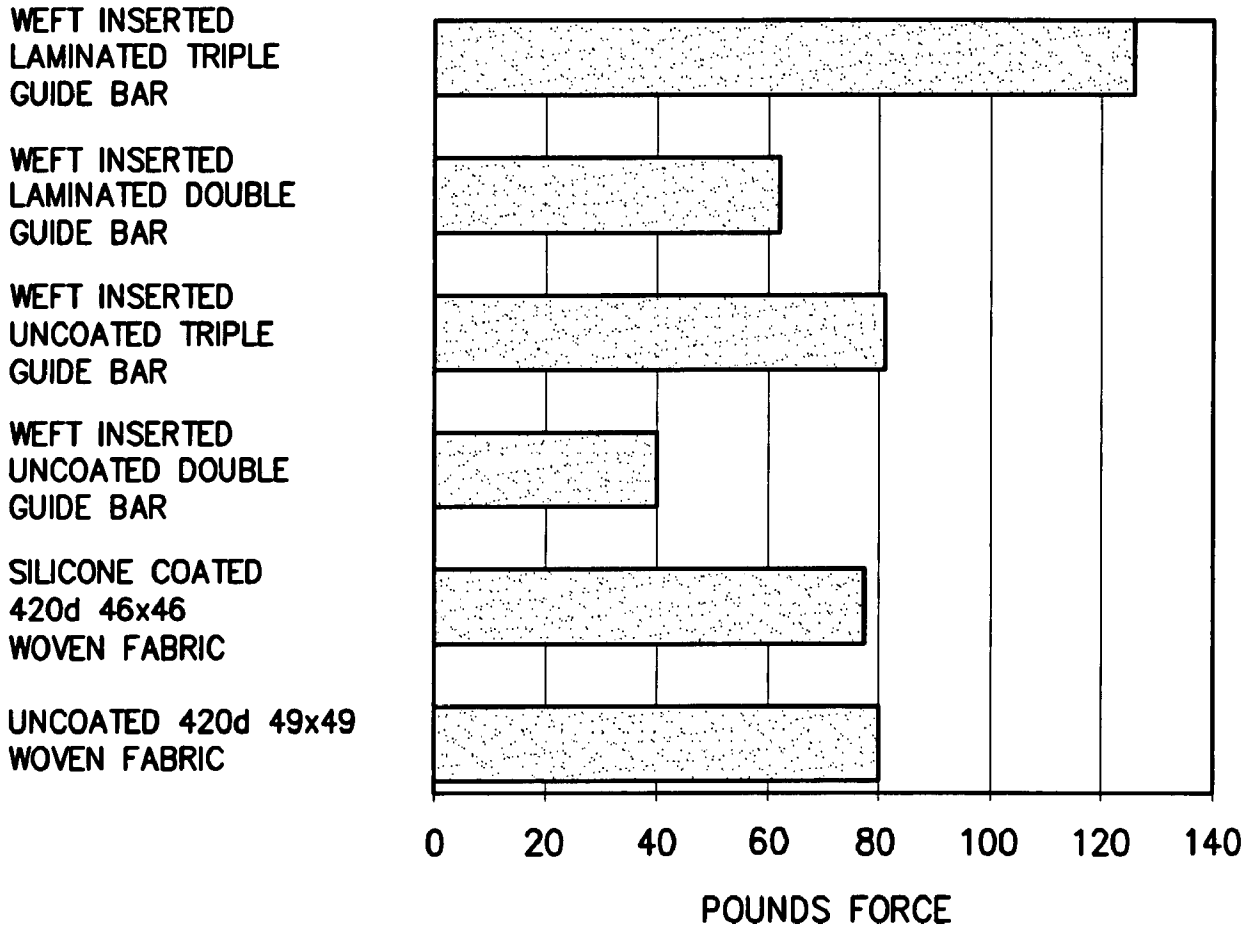
FIG. 11 is bar graph illustrating relative edgecomb resistance performance of various embodiments of the present invention and prior fabrics.

FIG. 9 illustrates a construction similar to FIG. 6 incorporating a ground layer 380 disposed between the warp yarns 346 and the weft yarns 344 and wherein elements corresponding to those previously described are designated by corresponding reference numerals within a 300 series. The ground layer 380 may be any suitable material including a polymeric film, fibrous textile or the like. A nonwoven batting material of polyester or the like may be particularly desirable. As will be appreciated, the ground layer 380 may provide a degree of anchoring support and stability for the tying yarns 350, 350'. The ground layer may also aid in establishing a base for an effective permeability blocking coating. Of course, it is also contemplated that the ground layer 380 may be positioned on one side or the other of the construction formed by the warp yarns and the weft yarns rather than being located between the yarns.

Figure 10:
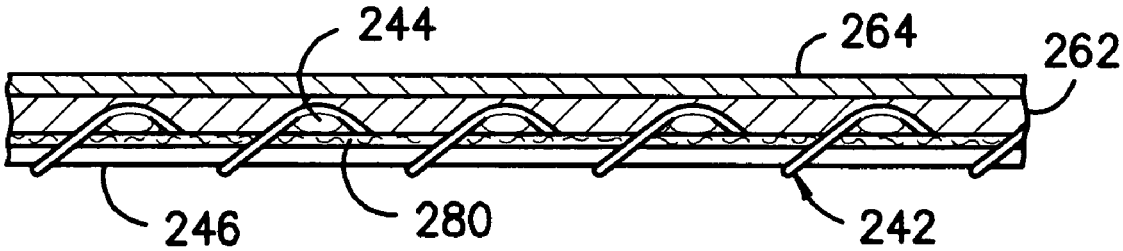
FIG. 10 is a view of an embodiment of a weft inserted warp knit substrate with an applied permeability blocking covering looking in the warp direction along line 10-10 in FIG. 8.

One embodiment of a resultant air bag panel material incorporating a fibrous or film ground layer 280 is illustrated in FIG. 10 wherein a weft inserted warp knit substrate 242 as previously described in relation to FIG. 8 is coated across one side with an adhesive precoat 262 and a film covering 264. Of course, the covering layers may also be applied across the other side of the substrate 242 or on both sides if desired. Likewise, suitable coatings may also be applied across one or both sides of a substrate 342 having multiple cooperative tying yarns as described in relation to FIG. 9.

As indicated previously, the construction of the air bag substrate material incorporating pairs of stitches at each row provides substantial resistance to seam combing thereby enhancing effective seam strength. In order to demonstrate combing resistance provided by fabric substrates formed according to the present invention, specimens of the two bar and three bar constructions as described in relation to FIGS. 3 and 6 respectively were subjected to edgecomb resistance testing using the procedures outlined in the current version of ASTM test method D6479 the contents of which are incorporated herein in their entirety. As will be appreciated by those of skill in the art, the measurement of a fabric's edgecomb resistance indicates the relative tendency of the fabric to pull apart under seam stress or similar action. The test is carried out by clamping one end of a test specimen within the jaw of a tensile testing machine. A special fixture pierces a row of equally spaced needle holes through opposite ends of the specimen. A tensile force is applied until rupture occurs. The measurement of the force required for rupture is the measurement of edgecomb resistance.

Edgecomb resistance tests were carried out on both the two guide bar weft inserted warp knit construction illustrated and described in relation to FIG. 3 and on the three guide bar weft inserted warp knit construction illustrated and described in relation to FIG. 6. These constructions were tested in both a laminated state and in an uncoated state. The two guide bar and three guide bar weft inserted warp knit constructions tested each utilized 500 denier polyester warp yarns and 500 denier polyester weft yarns with 80 denier polyester tying yarns. The finished yarn density for both the two bar and three bar constructions was 18 warp yarns per inch×17 weft yarns per inch. The laminated constructions utilized a polycarbonate polyurethane film held in place with an adhesive precoat. However, other suitable covering constructions can also be utilized. In the laminated constructions the total mass per unit area of the film and precoat was 0.9 ounces per square yard. Comparative edgecomb tests were also conducted on a silicone coated air bag fabric with the same coating weight formed from 420 denier nylon yarn at a weave density of 46 warp yarns per inch×46 weft yarns per inch as well as on an uncoated air bag fabric formed from 420 denier nylon yarn at a weave density of 49 warp yarns per inch×49 weft yarns per inch. The results of this comparative testing are presented graphically at FIG. 10 showing that embodiments of the present invention provide substantially equivalent or better results than traditional woven fabrics. In particular, even in the non-laminated (i.e. uncoated) state, both the double and triple guide bar constructions exhibited edgecomb resistance levels of about 40 pounds force or greater. Such results are achieved despite the fact that the weight of fiber used is reduced by about 35% relative to equivalently performing woven fabrics.

A comparative edgecomb test was also conducted on an uncoated traditional weft inserted warp knit fabric incorporating 500 denier polyester warp yarns and 500 denier polyester weft yarns with 80 denier polyester tying yarns with 18 warp yarns per inch×17 weft yarns per inch. Unlike the inventive constructions, the comparative sample had only one stitch formed at each row. The measured edgecomb resistance for the traditional weft inserted warp knit fabric was under 30 pounds thereby indicating substantially better performance by the construction of the present invention.

While the present invention has been illustrated and described in relation to certain potentially preferred embodiments and practices, it is to be understood that the illustrated and described embodiments and practices are illustrative only and that the present invention is in no event to be limited thereto. Rather, it is fully contemplated that modifications and variations to the present invention will no doubt occur to those of skill in the art upon reading the above description and/or through practice of the invention. It is therefore intended that the present invention shall extend to all such modifications and variations as may incorporate the broad aspects of the present invention within the full spirit and scope of the following claims and all equivalents thereto.

What is claimed is:

1. A coated vehicle air bag adapted to inflate upon occurrence of a collision event, the air bag comprising:

(a) one single panel of knitted material having two opposed sides, the panel comprising a fibrous substrate of weft inserted warp knit construction, wherein the fibrous substrate comprises a plurality of warp yarns disposed in a first plane and a plurality of weft yarns disposed in a second plane adjacent the first plane, wherein the warp yarns and the weft yarns are tied together by weft knitted stitching yarns, and wherein at least a portion of the stitching yarns form a double column pattern of stitches, said double column pattern of stitches being disposed on opposite sides of individual warp yarns at rows of stitch formation along the length of the warp yarns, further wherein stitches on the opposite sides of the warp yarns are formed by interlocking loops of the same yarn;

(b) a coating applied to one side of the single panel of material;

(c) wherein the coated air bag is substantially impermeable to air, the air bag being adapted for inflation during a collision event.

2. The invention as recited in claim 1, wherein the warp yarns comprise a linear density in the range of about 100 to about 900 denier.

3. The invention as recited in claim 1, wherein the weft yarns comprise by a linear density in the range of about 100 to about 900 denier.

4. The invention as recited in claim 1, wherein the substrate is at least partially covered with a permeability blocking coating.

5. The invention as recited in claim 4, wherein the permeability blocking coating is at least one of a transfer coating, an extrusion coating or a film adhesively bonded to at least one surface of the substrate.

6. The invention as recited in claim 1, wherein the air bag is a passenger side cushion.

7. The invention as recited in claim 1, wherein the air bag is an inflatable curtain.

8. The invention as recited in claim 1, wherein the substrate of weft inserted warp knit construction is characterized by an edgecomb resistance of not less than about 40 pounds force when tested in an uncoated state according to the procedures set forth in ASTM test method D6479.

9. The invention as recited in claim 1, further comprising a nonwoven ground layer perforated by the stitching yarns.

* * * * *

UNITED STATES PATENT AND TRADEMARK OFFICE

CERTIFICATE OF CORRECTION

PATENT NO. : 7,353,669 B2
APPLICATION NO. : 10/993987
DATED : April 8, 2008
INVENTOR(S) : Karen M. Green et al.

It is certified that error appears in the above-identified patent and that said Letters Patent is hereby corrected as shown below:

In column 10, line 18, delete the word “weft” and replace with “warp”.

In column 10, line 35, after the word “comprise” delete the word “by”.

Signed and Sealed this

Fourteenth Day of April, 2009

John Doll

JOHN DOLL
*Acting Director of the United States Patent and Trademark Office*